US005411244A

United States Patent [19]

Turner

[11] Patent Number: 5,411,244

[45] Date of Patent: May 2, 1995

[54] CLAMP USING ELASTIC TENSION MEMBER

[76] Inventor: Tommy P. Turner, 4243 Council Crest Cir., Battle Creek, Mich. 49017

[21] Appl. No.: 205,642

[22] Filed: Mar. 4, 1994

[51] Int. Cl.[6] ..... B25B 1/20

[52] U.S. Cl. ..... 269/42; 269/109; 269/115; 269/130

[58] Field of Search ..... 269/41-42, 269/108-109, 11, 115, 130-132

[56] References Cited

U.S. PATENT DOCUMENTS 1,053,556 2/1913 Bergstrom .
3,224,754 12/1965 Graham .
4,047,710 9/1977 Wilson .
4,163,547 8/1979 Jerome ..... 269/42
4,171,799 10/1979 Elko .
4,527,784 7/1985 Schwab .
4,560,153 12/1985 Han .
5,161,789 11/1992 Rogers .

*Primary Examiner*—Robert C. Watson
*Attorney, Agent, or Firm*—Beaman & Beaman

[57] ABSTRACT

A free clamp for holding the sides of a closed frame, box, chair legs, etc. during gluing or the like wherein the workpiece is engaged by clamp corner elements biased inwardly by an elastic tension cord. All of the corner elements, except one, include anti-friction rollers engaging the rubber tension member cord, and the ends of the cord are connected to an anchor corner element including a lock for receiving the elastic tension member and maintaining the tension therein. The tension member cord is mounted upon the corner elements in an asymmetrical relationship to permit the tension forces imposed upon the corner elements to be most advantageously applied to the frame sides during clamping.

3 Claims, 1 Drawing Sheet

CLAMP USING ELASTIC TENSION MEMBER

BACKGROUND OF THE INVENTION

1. Field of the Invention

The invention pertains to clamps of the picture frame type utilizing a plurality of frame engaging corner elements forced inwardly by a tension member.

2. Description of the Related Art

When gluing or otherwise assembling frames, such as picture frames, of a closed configuration defined by a plurality of frame sides interconnected at their ends, which are usually mitered, frame clamps are employed consisting of a corner element engaging each corner of the frame and interconnected by a tension member whereby tensioning thereof inwardly forces the corner elements into engagement with the frame sides to hold the frame sides in the desired relationship during gluing. Clamps of this type are also used when gluing boxes, chair legs, and other four sided articles. Such frame clamps have taken a variety of configurations using a plurality of features, as shown in the following patents typically illustrating frame clamp devices.

U.S. Pat. Nos. 4,171,799; 4,527,784 and 4,560,153 show frame clamps utilizing flexible tension members and separate corner elements wherein the tension member is stressed by a threaded shaft arrangement.

U.S. Pat. Nos. 4,047,710 and 5,161,789 disclose frame clamps using a tensioning strap and corner elements wherein the strap may be tensioned by a ratchet or buckle.

U.S. Pat. Nos. 1,053,556 and 3,224,754 disclose frame clamps using corner elements in conjunction with a flexible tension member wherein anti-friction rollers are used in engagement with the tension member to reduce the frictional forces between the tension member and the corner elements.

Frame clamps such as those disclosed in the above mentioned patents, and those presently available, are relatively complicated and expensive, difficult to use, and not readily adaptable for use with a variety of frame sizes, and heretofore, an inexpensive frame clamp easy to use by the unskilled has not been available.

OBJECTS OF THE INVENTION

It is an object of the invention to provide a frame clamp employing corner elements inwardly biased by a tension member wherein the tension member is elastic and will automatically maintain the desired assembly force upon the clamped frame in an equalized manner with a minimum of apparatus and skill.

Another object of the invention is to provide a frame clamp employing corner elements and a flexible resilient elastic tension member wherein the tension member is related to the corner elements in a substantially anti-friction manner, and the tension member may be retained under the desired tension by a simple lock in the form of a wedge into which the tension member is received. Yet another object of the invention is to provide a frame clamp supported upon the same surface supporting the frame sides during clamping wherein the biasing force imposed upon the frame sides by the corner elements is most advantageously related to the dimension of the frame sides with respect to the frame side support surface to minimize the likelihood of the clamping force being misaligned to the frame dimensions.

An additional object of the invention is to provide a frame clamp employing corner elements interconnected by a flexible elastic tension member wherein, for packaging or storing purposes, adjacent corner elements may be brought into engagement with each other to define a concise and substantially flat configuration.

SUMMARY OF THE INVENTION

In the practice of the invention, the clamp consists of three identical corner elements each employing an anti-friction roller and having tension member receiving bores defined therein tangentially related to the roller periphery whereby a cord of flexible resilient rubber, constituting the tension member, may be guided through the corner element bores passing around a portion of a roller periphery. In the fourth corner element, one end of the rubber cord is permanently anchored, and a cord receiving bore is also defined therein for receiving the cord free end through which the cord is pulled during tensioning thereof.

A V-shaped notch defined in the fourth corner element adjacent the bore receiving the tension member free end receives and retains the resilient cord under tension by a wedging action upon lateral displacement of the cord once the proper tension has been achieved.

Each of the corner elements includes frame side engaging surfaces, usually disposed at right angles to each other for receiving the frame corners, and these cushion element frame side engaging surfaces extend between spaced sides formed on the corner elements. When the clamp is assembled to the frame sides, the corner elements and the frame sides will be supported upon a planar support surface, such as a work bench, and in order to permit the frame clamp to accommodate a wide variety of frame dimensions, the corner element tension member guide bores, and rollers, are asymmetrically located on the corner elements with respect to the corner element supporting sides. In this manner, the corner elements may be placed upon the supporting surface so as to adjust the spacing of the tension member relative to the supporting surface, and thereby increase or decrease such spacing and achieve that spacing most desirable to equalize or "center" the clamping forces imposed upon the frame sides during clamping.

The corner elements may be economically constructed of wood or molded of a synthetic plastic, and the rubber cord tension member is also of an economical construction. Once the corner elements are properly located relative to the preliminarily assembled frame sides or other workpiece, the rubber cord may be pulled to produce a tension therein, the anti-friction rollers will equalize the clamping forces inwardly biasing the corner elements into engagement with the frame sides, and upon the desired tension being achieved within the resilient cord, the cord may be slipped into the V-notch to hold the cord against retraction and maintain the desired tension therein. After the frame sides have been glued, or otherwise assembled, the cord may be removed from the V-notch and the clamp components readily removed from the assembled frame.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
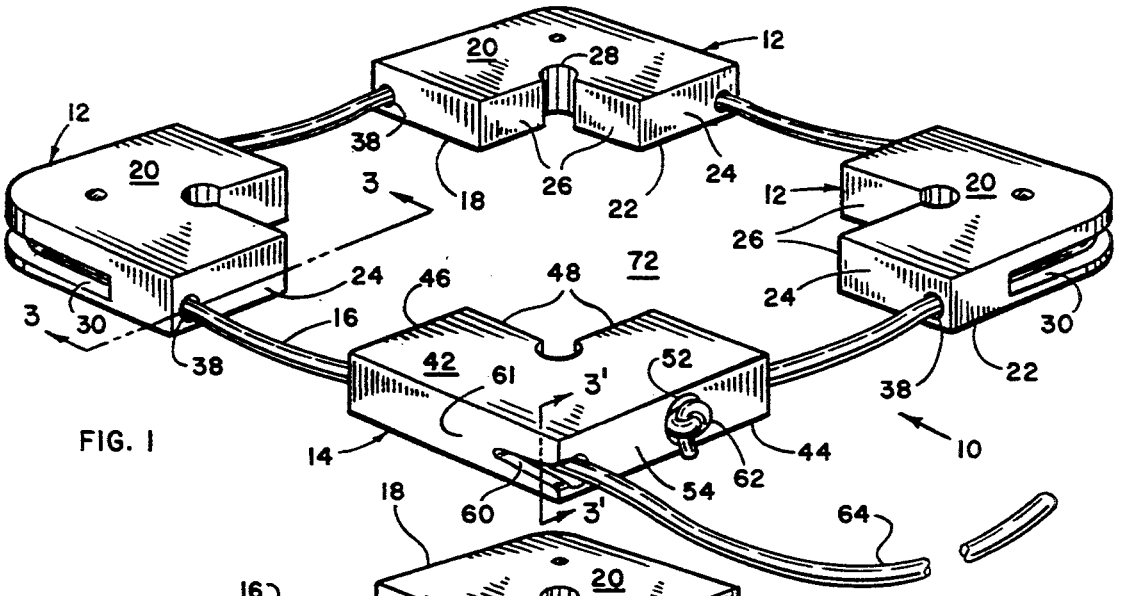
FIG. 1 is a perspective view of a framing clamp, per se, in accord with the invention, the components being shown in the preliminary assembled relationship prior to a workpiece being located therebetween.

In the drawings, the entire frame clamp is generally indicated at 10, and the frame clamp consists of three identical roller corner elements 12 and a single tension member anchor corner element 14. All of the corner elements are interconnected by a tension member 16 which consists of a flexible resilient elastic cord, preferably formed of rubber, neoprene, or the like.

The corner elements 12 are identical, and each includes a body 18 which may be formed of wood or molded of a synthetic plastic or metal. Each body 18 includes a top flat side 20, with respect to the orientation of the drawings, and a flat bottom side 22. The sides 20 and 22 are parallel to each other, and define the vertical height of the elements 12. The elements 12 also each include ends 24, and on the inside are each formed with frame side engaging surfaces 26 which are perpendicularly related to each other. The surfaces 26 extend between the top side 20 and the bottom side 22, and a relief hole 28 is defined in the body 18 between the surfaces 26 wherein the corner of a clamped frame can be received therein during clamping.

Figure 3:
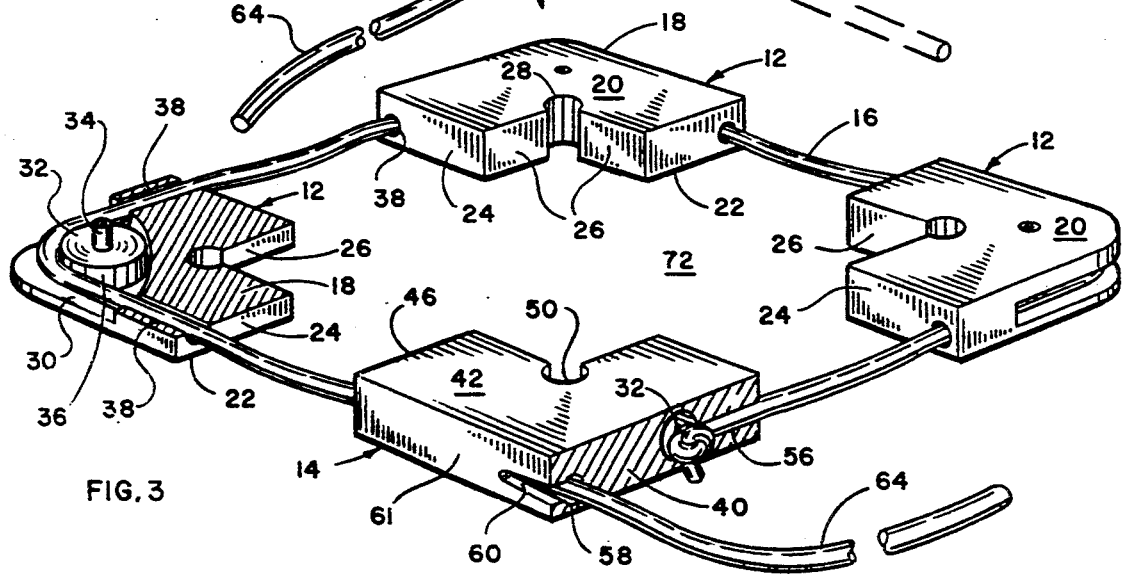
FIG. 3 is a perspective view similar to FIG. 1, a section being taken through one of the corner elements incorporating an anti-friction roller along Section 3—3 of FIG. 1, and a section being taken through the tension member anchor corner element along Section 3'—3' of FIG. 1.

Each of the corner elements 12 is provided with a slot 30, FIG. 3, having a roller 32 mounted therein rotatably mounted upon an axle 34 received within holes formed in the associated body 18 upon opposite sides of the slot 30. The roller periphery 36 is cylindrical, but could be grooved, if desired.

Each of the bodies 18 are provided with a pair of tension member receiving bores 38 which are each tangentially oriented to the periphery of the roller 32, for a purpose as later described.

The tension member anchor corner element 14 includes a body 40 which may be formed of wood, or molded of a suitable material. The body 40 includes a flat top side 42 and a bottom flat side 44, ends 46 and perpendicular frame side engaging surfaces 48 intersecting the corner relief hole 50.

The body 40 also includes a knothole 52 intersecting the body outer side 54, and the knothole 52 is intersected by a bore 56 which also intersects an end 46.

The anchor corner element body 40 also includes a notch bore 58 which intersects an end 46 and the outer side 54, and a V-shaped lock notch 60 is defined in the body 40 adjacent the notch bore 58 and defined within the side 61. The notch 60, as will be apparent from the drawings, is of a V or wedge type configuration wherein the widest portion of the notch 60 is adjacent the side 54. The notch 60 intersects the bore 58 as well as the side 54.

To assemble the frame clamp 10, the elastic tension member cord 16, at one end, is inserted into the bore 56 through the adjacent end 46 so that the cord end will be received within the knothole 52. The cord end is then knotted at 62, and the cord tensioned to pull the knot 62 into the knothole 52, and in this manner one end of the tension member 16 will be permanently anchored to the corner element 14.

The other end of the tension member 16 is now threaded through the bores 38 of the roller corner elements 12, and in doing so the tension member 16 will tangentially align with the roller 30 of each corner element 12, pass around the outer portion of the periphery of the roller 32 as will be appreciated from FIG. 3, and is then passed through the other guide bore 38 of the associated corner element. All three of the corner elements 12 are threaded upon the tension member 16 in this manner, and the free end of the tension member is then inserted through the notch bore 58 of corner element 14 as will be appreciated from the drawings. Accordingly, the tension member 16 will have a free end region 64 which extends from the notch bore 58, and the frame clamp 10 is now fully assembled.

Figure 2:
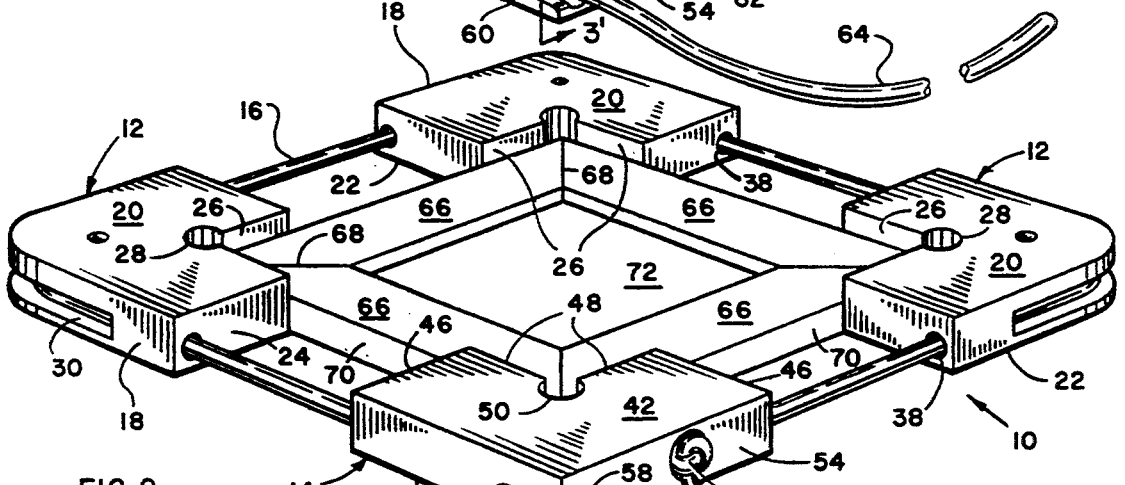
FIG. 2 is a perspective view of the clamp in accord with the invention as mounted upon a frame consisting of a plurality of sides having mitered ends, and the tension within the tension member being achieved, and the tension member being locked.

A closed frame, such as a picture frame, to be located within the frame clamp 10 for gluing, or the like, consists of four frame sides 66, FIG. 2, each of which is provided with a 45° miter 68 at its ends. The frame sides 66 each include outer surfaces 70 which, as will be later appreciated, engage the frame side engaging surfaces of the corner elements.

Use of the frame clamp 10 usually occurs on a flat support surface 72, such as a workbench, and the corner elements 12 and 14 will be supported upon the surface 72 by the bottom sides 22 and 44 in a relationship as shown in FIG. 1. Thereupon, with the tension member end region 64 being aligned with the notch bore 58 as shown in dotted lines in FIG. 2, the frame sides 66 may now be placed between the corner elements 12 and 14 upon the surface 72 in a manner as apparent in FIG. 2. The lower surface of the frame sides will directly engage the surface 72, and hence be co-planar to the lower surfaces of the clamp corner elements.

When initially positioning the frame sides 66 within the frame clamp 10, the corner elements may be spaced apart as desired to accommodate the longitudinal dimensions of the frame sides, and whether the frame sides define a rectangular or square frame is of no consequence as the frame clamp readily accommodates either configuration.

Initially, the frame sides 66 will be positioned on the support surface 72, and within the clamp corner elements, so that the mitered ends 68 are properly oriented, and a slight preliminary tension may be applied to the elastic tension member cord end region 64 to produce a slight tension within the cord 16. Such a preliminary tension will snugly draw the corner elements' surfaces 26 and 48 into engagement with the frame outer sides 70 producing a frictional engagement between the frame sides and corner elements to permit the frame sides and corner elements to be properly final assembled. Of course, prior to assembling, glue is usually applied to the mitered ends of the frame sides.

The preliminary tension within the tension member 16 is retained by laterally displacing the tension member end region 64 into the locking notch 60 as shown in full lines in FIG. 2. The dimension of the diameter of the cord 16 is so related to the dimension of the notch 60 that the notch will firmly engage the cord end region 64, and the tension between the corner elements will maintain the end region 64 within the notch, the tension endeavoring to hold the end region 64 deeper and tighter within the notch pinching or wedging the rubber cord and maintaining the desired tension within member 16.

Once the proper orientation between the frame sides and corner elements is achieved, the tension member end region 64 may again be aligned with notch bore 58 as shown in dotted lines in FIG. 2, the end region 64 is then firmly tensioned to produce the desired clamping force, and thereafter the end region 64 is laterally displaced to the full line position shown in FIG. 2 wherein the end region 64 is firmly received within and locked into the notch 60. This final tensioning of the member 16 will be maintained automatically during the entire clamping process.

Due to the use of the anti-friction rollers 32, there is little friction or drag imposed upon the tension member 16 intermediate the corner elements 12, and the biasing force imposed upon the elements 12 and 14 in an inner direction upon the frame sides 66 is substantially uniform at all corners. Accordingly, the use of the rollers 32 and the elastic tension cord 16 guarantees substantially uniform clamping forces at all four corners of the frame.

It is desirable that the frame clamp 10 accommodate a wide variety of frame dimensions, and accordingly, the "height" of the corner elements 12 and 14, as defined by the top and bottom sides thereof, is, preferably, at least three-quarters of an inch, and may be greater. When using the frame clamp 10 with a small or shallow frame wherein the "height" of the frame outer sides 70 is small, for instance a quarter of an inch, difficulty may be encountered in maintaining the corner elements 12 and 14 in the proper position to the frame size upon using a substantial tension in the tension member 16. Such a problem occurs because if the tensioning force as applied to the corner elements 12 and 14 is located equally spaced between the corner elements' top side 20 and bottom side 22, or anchor corner element top side 42 and bottom side 44, the force imposed upon the corner elements by the tension member may be located slightly "above" the configuration or height of the frame sides 66, which may cause the corner elements to "jump" over the frame sides, and it will be appreciated that the forces on the corner elements as imposed by the tension member 16 will normally be determined by the center line of the tension member.

To reduce the likelihood of the aforementioned problem occurring, particularly when clamping frames having small dimensional sides, the tension member 16 is asymmetrically related to the sides 20 and 22 of the corner elements 12 and the sides 42 and 44 of the anchor corner element 14, as will be appreciated from the drawing. For instance, the slot 30, roller 32 and bores 38 are closer to the bottom side 22 than they are to the top side 20 of the body 18. In a like manner, the knothole 52, bore 56, and notch bore 58 are closer to the bottom side 44 of the bottom 40 than they are to the top side 42. Accordingly, when the frame clamp components are assembled as shown in the drawings wherein the sides 22 and 44 are located upon the support surface 72 the "plane" in which the tension force exists is closer to the support surface 22 than in that situation wherein the corner elements 14 and 24 are inverted so that the sides 20 and 42 rest upon the support surface 72, which will "raise" the plane in which the tension forces exist and permit the frame clamp 10 to be used with frame sides having larger dimensions at side 70. Accordingly, by asymmetrically relating the rollers and guide bores of the tension member 16 to the supporting sides of the elements 12 and 14 merely by inverting the corner elements the height of the plane of the tension forces within the corner elements may be easily regulated to accommodate the height dimensions of the frame being assembled to permit high assembly tens ion forces to be achieved without encountering disengagement of the corner elements with the frame sides.

In this description and claims, the clamp is described as a "frame" clamp in that its primary use will be to hold closed frames together during assembly. Such frames may constitute picture frames, but would also include window frames, screen frames, and the like. Additionally, the clamp of the invention may be used during the construction of boxes, and may be employed to hold the legs of chairs together while gluing the chair leg braces. A clamp of this type may be used in most situations wherein it is desired to impose an inwardly biasing force upon members while being glued, or otherwise assembled, and in the application and claims the description of the clamp as a "frame" clamp is not to be considered as limiting the use of the clamp to a frame.

It is appreciated that various modifications to the inventive concepts may be apparent to those skilled in the art without departing from the spirit and scope of the invention. For instance, if a closed frame having more than four corners is to be assembled using the inventive concepts, the configuration of the corner elements will be modified, and the number of corner elements using rollers will be one less than the number of corners of the frame being assembled.

I claim:

1. A frame clamp for assembling a plurality of side members to form a closed frame wherein adjacent side members engage and define corners comprising, in combination, a plurality of firs corner elements each having side member corner engaging surfaces defined thereon, an anti-friction roller rotatably mounted upon each of said first corner elements, a second corner element having side member corner engaging surfaces defined thereon, a flexible elastic resilient tension member having a first end and a second end region, a tension member anchor defined on said second corner element, said tension member first end being affixed to said tension member anchor, a tension member lock defined on said second corner element for receiving said tension member second end region, said lock being selectively engageable with said tension member second end region to adjustably lock said tension member second end region with respect to said second corner element upon said tension member being under tension and comprising a wedge shaped notch defined on said second corner element receiving and retaining said tension member, said tension member passing about said anti-friction rollers of said first corner elements upon said first and second corner elements being located at the corners of a frame whereby upon tensioning of said tension member said second end region may be locked with respect to said second corner element to maintain the tension within said tension member and all of said corner elements will be substantially equally biased into engagement with the frame side members.

2. In a frame clamp as in claim 1, said tension member comprising a rubber cord.

3. A frame clamp for assembling a plurality of side members to form a closed frame wherein adjacent side members engage and define corners comprising, in combination, a plurality of first corner elements each having side member corner engaging surfaces defined thereon, an anti-friction roller rotatably mounted upon each of said first corner elements, a second corner element having side member corner engaging surfaces defined thereon, a flexible elastic resilient tension member having a first end and a second end region, a tension member anchor defined on said second corner element, said tension member first end being affixed to said tension member anchor, a tension member lock defined on said second corner element for receiving said tension member second end region, said lock being selectively engageable with said tension member second end region to adjustably lock said tension member second end region with respect to said second corner element upon said tension member being under tension, said tension member passing about said anti-friction rollers of said first corner elements upon said first and second corner elements being located at the corners of a frame whereby upon tensioning of said tension member said second end region may be locked with respect to said second corner element to maintain the tension within said tension member and all of said corner elements will be substantially equally biased into engagement with the frame side members, a bore defined in said second corner element, said tension member second end region being axially displaceably received within said bore, first and second intersecting sides defined on said second corner element, said bore intersecting said first side, a wedge shaped notch having wide and narrow ends defined in said second side intersecting said bore, said notch wide end intersecting said first side, said notch comprising said lock and selectively receiving and retaining said tension member upon lateral displacement of said tension member second end region relative to said bore adjacent said first side.

* * * * *